US010996632B2

(12) United States Patent
Rannoux et al.

(10) Patent No.: US 10,996,632 B2
(45) Date of Patent: May 4, 2021

(54) VARIABLE COLOUR EXTERIOR ELEMENT

(71) Applicant: The Swatch Group Research and Development Ltd., Martin (CH)

(72) Inventors: Claire Rannoux, Lausanne (CH); Nicolas Francois, Neuchatel (CH); Milan Calic, Lausanne (CH); Stewes Bourban, Chabrey (CH)

(73) Assignee: The Swatch Group Research and Development Ltd, Marin (CH)

( * ) Notice: Subject to any disclaimer, the term of this patent is extended or adjusted under 35 U.S.C. 154(b) by 424 days.

(21) Appl. No.: 16/060,712

(22) PCT Filed: Dec. 5, 2016

(86) PCT No.: PCT/EP2016/079709
§ 371 (c)(1),
(2) Date: Jun. 8, 2018

(87) PCT Pub. No.: WO2017/097690
PCT Pub. Date: Jun. 15, 2017

(65) Prior Publication Data

US 2018/0364646 A1 Dec. 20, 2018

(30) Foreign Application Priority Data

Dec. 9, 2015 (EP) ..... 15198688

(51) Int. Cl.
*G04B 45/00* (2006.01)
*A44C 5/00* (2006.01)
(Continued)

(52) U.S. Cl.
CPC ..... *G04B 45/0015* (2013.01); *A44C 5/0053* (2013.01); *A44C 27/005* (2013.01); *G04B 37/22* (2013.01); *G04B 45/0076* (2013.01)

(58) Field of Classification Search
CPC G04B 45/0015; G04B 37/22; G04B 45/0076; A44C 5/0053; A44C 27/005
See application file for complete search history.

(56) References Cited

U.S. PATENT DOCUMENTS 4,397,566 A * 8/1983 Lederrey ..... G04B 37/0008 368/276
5,113,599 A 5/1992 Cohen et al.
(Continued)

FOREIGN PATENT DOCUMENTS

| | | | |
|---|---|---|---|
| EP | 1 017 209 | A2 | 7/2000 |
| FR | 2 821 233 | A1 | 8/2002 |
| WO | WO 2009/050412 | A1 | 4/2009 |

OTHER PUBLICATIONS

International Search Report dated Apr. 18, 2017, in PCT/EP2016/079709 filed Dec. 5, 2016.
(Continued)

*Primary Examiner* — Nimeshkumar D Patel
*Assistant Examiner* — Tania Courson
(74) *Attorney, Agent, or Firm* — Oblon, McClelland, Maier & Neustadt, L.L.P.

(57) ABSTRACT

An exterior element for portable objects including a support, on which is arranged a first material, the first material being chosen to be capable of reflecting different visible wavelengths as a function of applied stress.

21 Claims, 8 Drawing Sheets

(51) Int. Cl.
*A44C 27/00* (2006.01)
*G04B 37/22* (2006.01)

(56) References Cited

U.S. PATENT DOCUMENTS

| | | | | |
|---|---|---|---|---|
| 5,484,205 | A * | 1/1996 | Grupp | G01K 1/02 368/11 |
| 5,972,526 | A * | 10/1999 | Matsumoto | C23C 14/16 428/644 |
| 6,463,011 | B1 * | 10/2002 | Christen | G04C 3/005 368/69 |
| 6,466,299 | B1 | 10/2002 | Lehtiniemi et al. | |
| 7,159,469 | B2 * | 1/2007 | Claude | G04G 21/02 368/11 |
| 7,932,893 | B1 * | 4/2011 | Berthaud | G04G 21/08 345/157 |
| 10,021,933 | B2 * | 7/2018 | Donovan | G02F 1/163 |
| 10,114,238 | B2 * | 10/2018 | Chang-Hasnain | G02B 1/002 |
| 10,482,361 | B2 * | 11/2019 | Yanson | G06K 19/0614 |
| 2006/0133213 | A1 * | 6/2006 | Robert | G04G 21/02 368/11 |
| 2010/0012017 | A1 * | 1/2010 | Miller | G01J 1/429 116/201 |
| 2010/0149929 | A1 * | 6/2010 | Braunberger | H01M 6/18 368/223 |
| 2010/0236682 | A1 | 9/2010 | Patient et al. | |
| 2011/0102795 | A1 | 5/2011 | Peng et al. | |
| 2012/0049139 | A1 * | 3/2012 | Ono | C09K 9/02 252/583 |
| 2012/0087213 | A1 * | 4/2012 | Caldwell | A63B 69/0002 368/11 |
| 2012/0091699 | A1 * | 4/2012 | Krueger | B42D 25/29 283/67 |
| 2012/0229881 | A1 * | 9/2012 | Hollman | G02F 1/178 359/245 |
| 2013/0017948 | A1 * | 1/2013 | Charlson | G02B 26/004 503/201 |
| 2013/0288035 | A1 | 10/2013 | Baumberg et al. | |
| 2015/0108917 | A1 | 4/2015 | Hamer | |
| 2015/0366518 | A1 * | 12/2015 | Sampson | A61B 5/0478 600/301 |
| 2016/0170376 | A1 * | 6/2016 | Francois | G04G 17/08 368/10 |
| 2017/0059890 | A1 * | 3/2017 | Wilson | G01L 1/24 |
| 2018/0284491 | A1 * | 10/2018 | Francois | B32B 27/283 |

OTHER PUBLICATIONS

Baumberg, J., "Stretching the imagination", Textiles, vol. 4, Issue 4, 2009, pp. 8-10, XP002758458.

Zhu, L. et al., "Flexible photonic metastructures for tunable coloration", Optica, vol. 2, No. 3, Mar. 2015, pp. 255-258, XP002758459.

* cited by examiner

VARIABLE COLOUR EXTERIOR ELEMENT

CROSS-REFERENCE TO RELATED APPLICATIONS

This is a National phase Application in the United States of International Patent Application PCT/EP2016/079709 tiled on Dec. 5, 2016 which claims priority on European patent application No. 15198688.2 of Dec. 9, 2015. The entire disclosure of the above patent applications are hereby incorporated by reference.

The present invention concerns an exterior element for a portable object comprising a support on which is arranged a first material, said first material being chosen to be capable of selectively reflecting different visible wavelengths according to the stress applied.

BACKGROUND OF THE INVENTION

There are known portable objects such as watches that are equipped with coloured exterior elements. Generally, the exterior elements are coloured with a colour or a particular pattern and this colouring is permanent.

However, there is a need for a watch provided with an exterior element whose colour can vary. This need arises from the wish of consumers to be able to change the colour of their watch or portable device according to their desires or moods.

An obvious solution consists in providing accessories such as telephone cases or replacement parts that can easily be replaced by the user.

Nonetheless, the drawback of this solution is that it becomes necessary for users to have a stock of replacement parts, these parts may be lost, and it then becomes necessary to renew the stock each time that the watch or telephone is changed.

Another solution consists in using colour changing pigments; these pigments may be photochromic or thermochromic. These pigments are incorporated in ink or directly in the material forming the exterior element. A change in temperature or light is then sufficient to change the colour of the exterior element.

A drawback here is that this configuration is not controllable. Indeed, these pigments react at specific temperature or light values, so that the consumer has little control over these elements and is dependent thereon.

There is therefore a need for an exterior element whose colour variation can be controlled.

SUMMARY OF THE INVENTION

The invention concerns an exterior element that overcomes the aforementioned drawbacks of the prior art by proposing an exterior element for portable objects that allows for controllable colour variation.

To this end, it is an object of the invention to provide an exterior element for portable objects including a support, on which is arranged a first material, said first material being chosen to be capable of selectively reflecting different visible wavelengths according to the stress applied, said exterior element further comprising a device that allows to modify the stress applied to said first material.

This invention advantageously makes it possible to have an exterior element whose colour can be changed without having to apply a coat of paint or without having to add a coloured case.

In a first advantageous embodiment, the support and the device that allows to modify the stress applied to said first material are one and the same piece.

In a second advantageous embodiment, the support is a bistable metal band coated with said first material.

In a third advantageous embodiment, the device which allows to modify the stress applied to said first material uses a second material whose volume is capable of varying as a function of a physical magnitude, said second material being associated with a flexible element carrying the first material.

In a fourth advantageous embodiment, the support includes at least one recess closed by a film provided with the first material and forming a housing, said housing accommodating a capsule composed of two joined half-shells filled with said second material.

In a fifth advantageous embodiment, the support includes at least one recess closed by a film provided with the first material and forming a housing, inside which a capsule/piston system and the material are placed, said capsule/piston system is formed of a half-shell and a piston, such that the variation in volume of the second material causes movement of the piston.

In a sixth advantageous embodiment, each capsule is filled with said second material, which may be different from one capsule to another.

In another advantageous embodiment, each recess is filled with said second material, which may be different from one housing to another.

In another advantageous embodiment, the support is formed by at least two joined parts, secured to each other by their periphery, so as to leave an empty space between the two parts, at least one of the two parts being flexible and carrying said first material, with said space forming the recess containing the second material.

In another advantageous embodiment, the support formed by the at least two parts further includes at least one structure extending between the two parts to delimit at least two areas, each area being able to contain a bladder.

In another advantageous embodiment, each area contains a second specific material.

In another advantageous embodiment, the device which allows to modify the stress applied to said first material includes a bladder made of plastic materials connected to a pump system allowing the bladder to be inflated/deflated, said pump system including a hollow air cavity provided with a hole for filling the air cavity with air and a non-return valve including a pair of sheets of plastic material both welded to a wall of the pump, said sheets being bent substantially in a U-shape and arranged with respect to each other to only allow air to pass in the direction of the bladder, said device being associated with a flexible element carrying the first material.

In another advantageous embodiment, the support is formed by at least two parts fixed to each other by their periphery so as to leave an empty space between them, said space allowing the bladder to be housed therein, one of the parts forming the portion being provided with an aperture so that the pump system can be inserted therein and remain accessible.

In another advantageous embodiment, at least one of the two parts is flexible and carries the first material.

In another advantageous embodiment, the at least one of the two parts is perforated, the first material being held by the bladder acting as flexible element, and visible through the perforations.

In another advantageous embodiment, the support is formed by at least two joined parts secured to each other by their periphery, so as to leave an empty space between these two parts, at least one of the two parts being flexible and carrying the first material, said space forming the bladder of the pump system, one of the parts forming the portion being provided with an aperture so that the pump system is arranged therein.

In another advantageous embodiment, said first material takes the form of a film deposited on said support.

In another advantageous embodiment, the flexible element is at least partly formed by the first material.

In another advantageous embodiment, the flexible part is at least partly formed by the first material.

The invention also concerns a portable object including a case closed by a case back and a cover, characterized in that said portable object includes at least one exterior element according to any of the preceding claims.

In an advantageous embodiment, said portable object is a timepiece including a case formed by a case middle closed by a case back and a crystal, and a wristband fixed to the case middle by two pairs of horns, said wristband being provided with at least one wristband portion, and the exterior element is chosen within the list comprising the case middle, bezel, crown, push button, case back, wristband and buckle.

In another advantageous embodiment, said timepiece further comprises a timepiece movement providing time information to display means including a dial, said dial forming part of the list from which the exterior element is chosen.

BRIEF DESCRIPTION OF THE DRAWINGS

The advantages of an exterior element of this type will appear clearly upon reading the following description and on examining the illustrative drawing, in which.

DETAILED DESCRIPTION

The present invention concerns an exterior element 10 for a portable object 1. Said portable object may be, for example, a timepiece or watch 1. A conventional portable object includes a case, closed by a case back and a cover, and contains a device housed inside the case. Evidently, this portable object may be a telephone or a computer or an electronic touch tablet or a piece of jewelry, such as a bracelet. It may also be a fashion accessory, such as a bag or spectacles.

Figure 1:
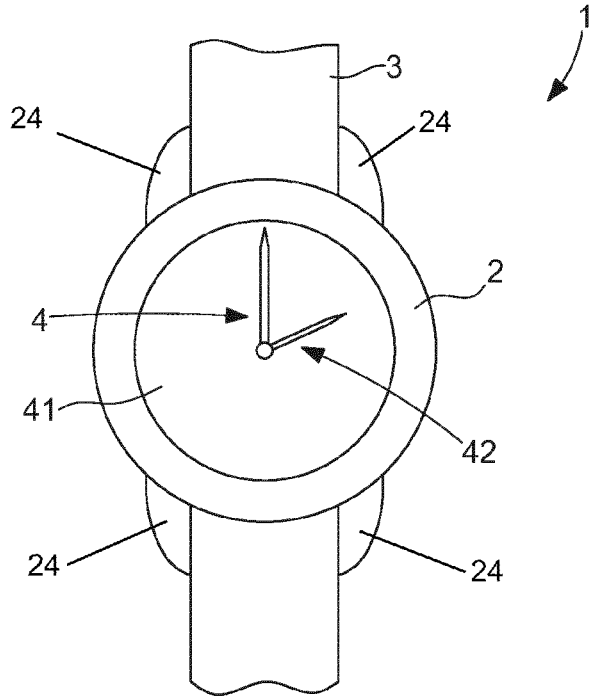
FIGS. 1 and 2 schematically represent a portable object according to the present invention.
Figure 2:
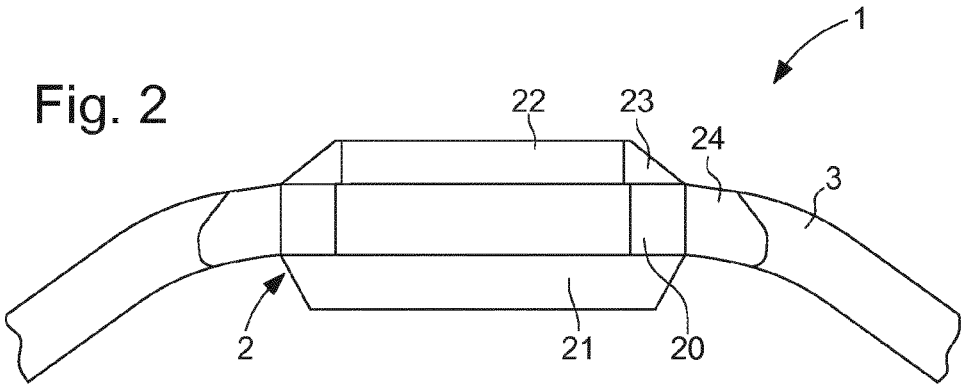

In the case where the portable object is a timepiece, the timepiece 1, seen in FIGS. 1 and 2, is, for example, a wristwatch comprising a case 2. This case 2 is formed by a case middle 20 closed by a case back 21 and a crystal 22. The timepiece also includes a wristband or bracelet 3. The latter is fixed, for example, by two pairs of horns 24, to the case middle. Wristband 3 may be formed of two wristband portions, each portion being fixed to a pair of horns and connected to the other portion via a clasp. The timepiece further includes a mechanical or electronic timepiece movement providing time information to display means 4. These display means include, for example, a dial 41 and hands 42 or discs 43 or an LCD screen 44.

The exterior element includes a frame 12 also called a support and made of a metal or plastic material. According to the invention, exterior element 10 uses a first material M1 capable of selectively reflecting different visible wavelengths according to the stress applied thereto. Indeed, there are known materials that are capable of creating so-called 'structural' colours. These materials are composed of at least two, periodically alternating elements with different refractive indices. The size of the elements is on the order of magnitude of the wavelength of light so that optical interference phenomena are created (constructive and destructive waves) which result in the selective reflection of certain wavelengths. The interference phenomena, and thus the reflected colours, depend on the size of the periodic grating and refractive indices of the at least 2 elements selected. In nature there are several examples of structural colours. Butterfly wings and opals can be mentioned.

This type of materials (called photonic crystals or opal materials) can also be synthesised by techniques known to those skilled in the art. Synthetic photonic crystals are generally made by the ordered assembly of monodispersed bimaterial spheres (with 2 different refractive indices at the core and at the periphery).

The ordered sphere grating can be achieved:

1) by crystallisation, sedimentation, evaporation of a colloidal suspension (the technology is used in particular in the inks P-Ink® and Elast-Ink®)

2) under the effect of an electric field (as described by Baumberg, Advanced Engineering Materials 2013, p. 948), 3) under the effect of shearing forces during extrusion (as described by Baumberg, Stretching the imagination, Textiles, issue 4, 2009, 8-10 and US 2013/0288035, Manufacture of composite optical materials).

The periodic grating thereby formed is then solidified by polymerization.

A second method for producing photonic crystals consists in creating nanometric-sized "studs" on thin flexible film (typically a PDMS sheet). Researchers at the University of California Berkeley thus used lithography techniques to produce silicon pixel arrays, which they then encapsulated in 2 PDMS sheets (Flexible photonic metastructures for tunable coloration, Optical Letters, 2015, p. 255) to produce a thin flexible film that can change colour at will under the effect of small deformations.

Indeed, when a structural colour material is flexible or deposited on a flexible support, the periodic grating can then be modified by varying the geometric dimensions of the material and it is thus possible to obtain a material with structural colours that change in a controlled manner when the material is mechanically stressed. The geometric dimensions are changed by applying stress to said material. These stresses may be stretching, compressive, torsional, pinching or any other stresses allowing modification of the shape and/or dimensions of the material.

This first material M1 may thus take the form of a more or less thick film or be incorporated directly in the substrate forming exterior element 10. In the case of a film, a first configuration allows first material M1 to simply comprise an opal film or band obtained by the techniques described above. In a second configuration, said first material M1 includes the opal film assembled on a flexible film. In a third configuration, said first material M1 includes the opal film encapsulated in two flexible films. The flexible films are preferably PDMS films or thermoplastic films, preferentially thermoplastic polyurethane films.

Consequently, exterior element 10 according to the invention must be provided with a device 14 allowing stress to be applied to first material M1 to make it change colour, in addition to support 12.

In a first embodiment, exterior element 10 is configured such that support 12 and device 14, which allow stress to be applied to the first material to make it change colour, are one and the same element. It is understood then that the support is capable, by virtue of its features, of being manipulated to produce mechanical stress on first material M1.

Figure 3A:
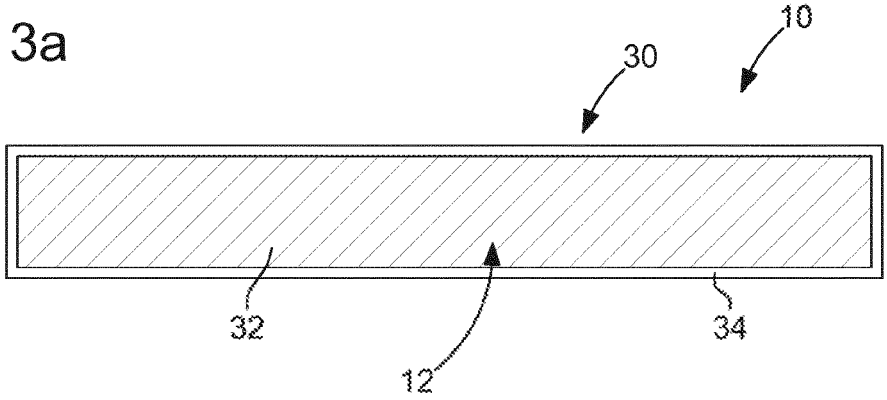
FIGS. 3*a*, 3*b* and 3*c* schematically represent a first embodiment of the exterior element according to the present invention.

According to one embodiment, exterior element 10 is a so-called 'slap strap' or 'slap band'. Such a strap or band 30 is composed of a bistable band of metal 32 acting as support 12. Strap or band 30 can be laid flat by tensioning bistable metal band 32 and then wound again around the wrist by slapping the strap. This bistable metal band 32 can then be coated with a protective layer 34. This protective layer 34 may be an overmoulded plastic material or a film or an ink that hardens to improve its aesthetics as seen in FIG. 3*a*.

Advantageously according to this first embodiment, the first material M1 is arranged on the bistable metal band.

Figure 3B:
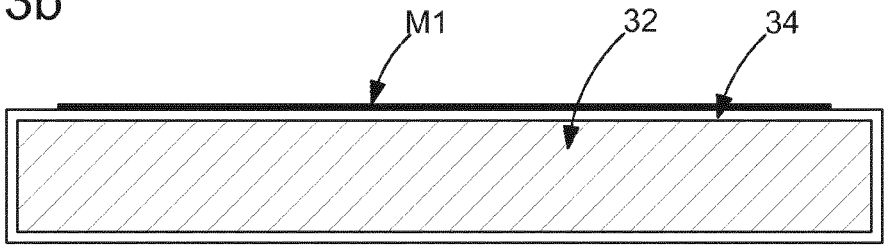

In a first configuration, the first material is arranged to cover the entire surface of strap 30. First material M1 can then take the form of a more or less thick film which may be adhesive bonded and/or sewn and/or assembled by adhesive bonding, ultrasonic welding, laser welding, infra-red welding or directly extruded onto bistable metal band 32, as seen in FIG. 3*a* or overmoulded onto support 12. A protective layer 34 (varnish or thermoplastic) can then be applied thereon. First material M1 could then be placed either on metal band 32 or on protective layer 34 of bistable metal band 32, as seen in FIG. 3*b*.

In a second preferred configuration, for ease of process, said material M1 is deposited on strap 30 and then overmoulded with a transparent TPU type thermoplastic.

In a third preferred configuration, for ease of process, said first material M1 includes an opal film encapsulated in 2 transparent (TPU type) thermoplastic films and material M1 is assembled to the strap by heat welding techniques.

Figure 3C:
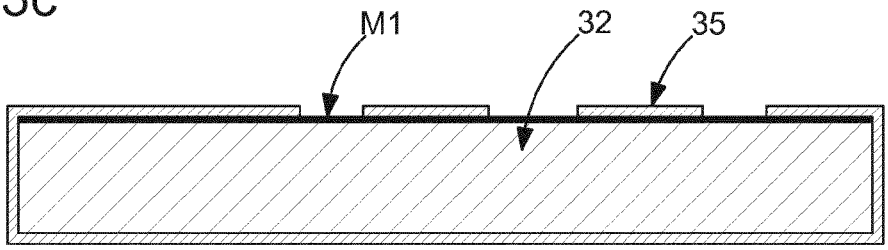

In another configuration, first material M1 is visible at certain specific places on the strap. For example, first material M1 is placed on the bistable metal band (sewn, bonded, overmoulded, assembled or extruded), then a perforated second layer 35 (leather, thermoplastic . . . ) is set in place to reveal first material M1, as seen in FIG. 3*c*.

Thus, when bistable metal band 32 changes from one state to another, i.e. from the state in which the metal band is tensioned to the state in which metal band 32 is not tensioned and is wound, a variation in stress occurs on the metal band. This variation in stress is transmitted to first material M1. First material M1 is capable of reflecting different wavelengths according to the stress applied thereto. Consequently, when slap strap 30 changes from one state to another, the variation in stress allows first material M1 to reflect different wavelengths and thus provides a strap having different designs according to whether or not it is wound.

In a second embodiment, support 12 and device 14 for applying stress to first material M1 to make it change colour are separate, and application of stress to the first material occurs via a material M2 whose volume varies as a function of a physical magnitude. This physical magnitude could be temperature. More preferentially, material M2 is a liquid with a boiling point at atmospheric pressure comprised between 0 and 60° C. In these conditions, when a temperature higher than the boiling point of M2 is applied to the exterior element, material M2 changes into gas phase and its volume therefore increases. For example, material M2 is ethyl chloride, butane, propane or a mixture of these compounds.

Figure 4A:
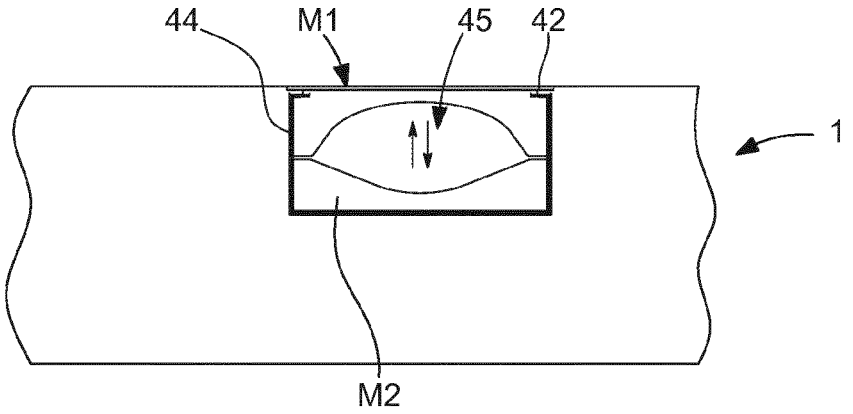
FIGS. 4*a* to 8 schematically represent a first variant of a second embodiment of the exterior element according to the invention.
Figure 4B:
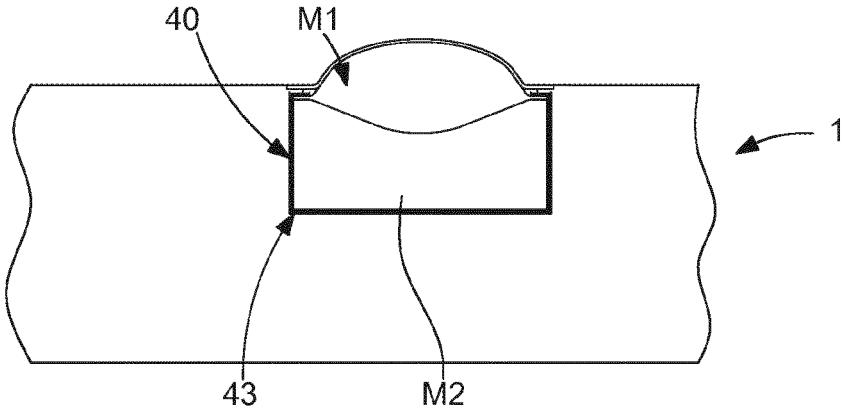

In a first embodiment, support 12 includes at least one recess 40. This at least one recess 40 is used for placing a capsule/piston system 43 and material M2 therein. This capsule/piston system 43, which is impermeable to material M2, is formed of a half shell 44 and a piston 45 as seen in FIGS. 4*a* and 4*b*. Recess 40 is closed by a film 42 formed of material M1 or carrying material M1. Consequently, when the temperature increases, the volume of material M2 increases and acts on piston 45. Piston 45 has a rounded outer surface which comes into contact with the film of said material M1 when the piston is in the high position. In this manner, when piston 45 is pushed by material M2, it stretches material M1 which then changes colour.

The capsule/piston 43 thus formed is then placed inside a recess 40 in the exterior element. This capsule/piston 43 may be adhesive bonded, driven in, welded, screwed in, or set inside the recess to hold it therein. In a preferred embodiment, the exterior element is incorporated in a thermoplastic component of the portable object (for example, the strap, dial, watch case . . . ) and the thermoplastic component of the portable object carrying exterior element 1 is overmoulded directly onto capsule/piston 43, thereby forming recess 40. In this case, very good adhesion is obtained between the exterior element and the portable object in which it is incorporated.

In an alternative configuration, said first material M1 includes an opal film encapsulated in 2 films of transparent (TPU type) thermoplastic and material M1 is assembled, for example, by heat welding or adhesive bonding.

Figure 4C:
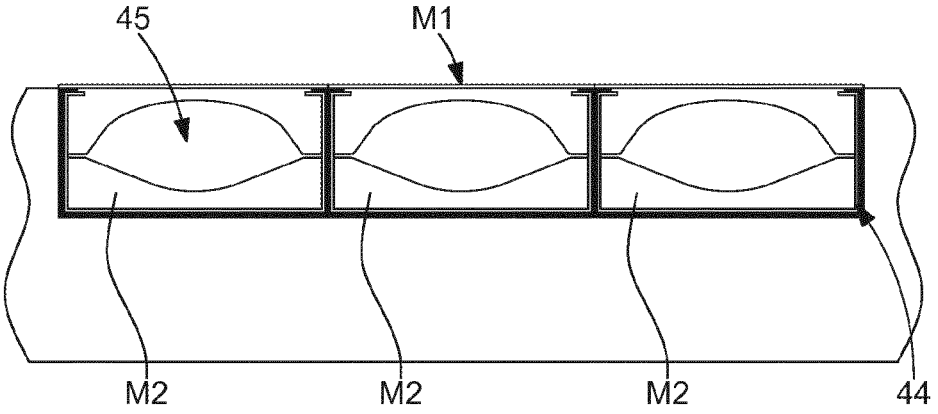

This configuration advantageously allows to make recesses 40 which each accommodate one capsule/piston 43, as seen in FIG. 4*c*. These capsules may include specific and different materials M2.

In this embodiment, the variation in colouration of material M1 capable of reflecting different wavelengths according to the stress applied thereto is possible. Indeed, the material of the invention is capable of reflecting different wavelengths according to the applied stress so that, for the same material, a difference in stress entails a different colour variation.

To achieve this, a first solution consists in modifying the dimensions: length, volume of capsule/piston 43 or recess 40. These dimensional changes then cause a different response to the stress applied by expansion of material M2.

A second solution consists in using different variants of material M2, each variant having a different expansion coefficient. This solution makes it possible to obtain different colour variations with capsules 43 or a recess 40 of the same size, since material M2 will be different.

A third solution consists in using different materials for the embodiments of membrane 42. Indeed, using materials that each have different deformation properties ensures that the stress applied to material M1 will be different and thus the colour variation will be different. A specific material M1 could also be provided for each capsule/piston 43.

These possibilities make it possible to produce an exterior element 1 provided with a multitude of areas using first material M1, with the different areas able to have features allowing for different colour variations.

Figure 5A:
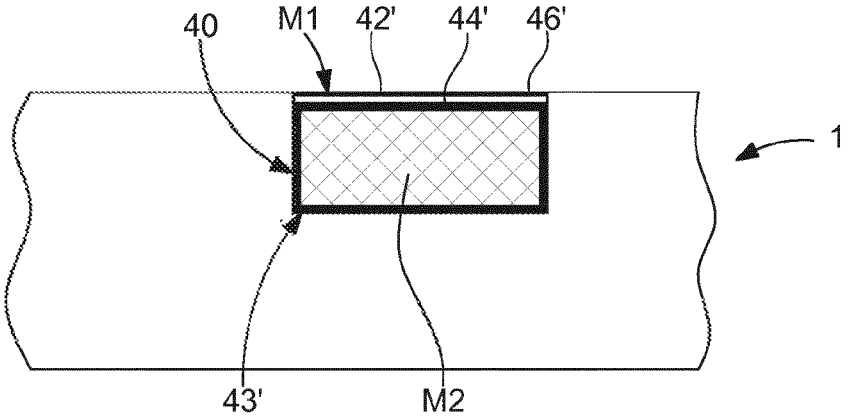
Figure 5B:
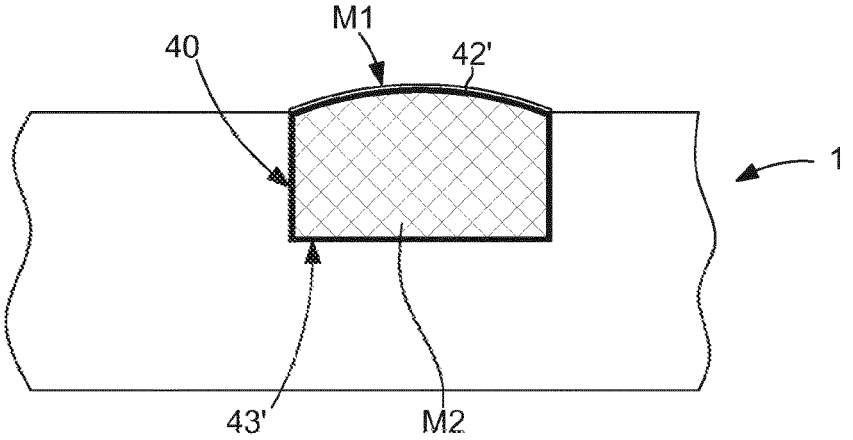
Figure 5C:
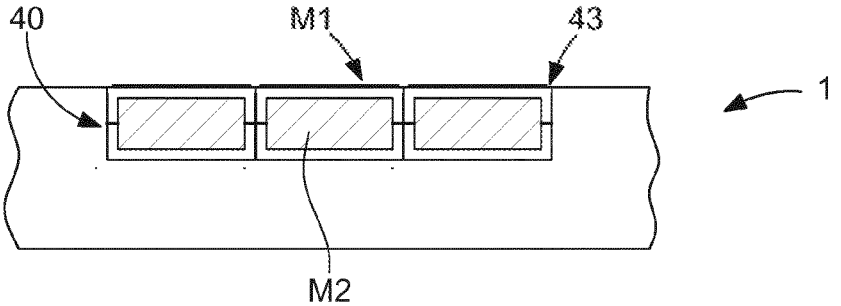

In a second embodiment, recess 40 is used to house a capsule 43' provided with two half-shells 44' made of flexible material, as seen in FIGS. 5*a* and 5*b*. This capsule 43' is then secured inside the recess by adhesive bonding or heat welding one of the half-shells 44'. This capsule 43' is also arranged to be filled with a material M2 that expands as a function of a physical magnitude, such as temperature or pressure. Recess 40 is closed by a film 42' made with material M1. Consequently, when the temperature increases for example, the material M2 inside the capsule expands and deforms half-shell 44'. This half-shell 44' in turn exerts stress on film 42'. This stress deforms film 42' and thus material M1 reflects a different wavelength. Several capsules 43' could be provided per recess 40, as seen in FIG. 5*c*.

In an alternative to this second embodiment, exterior element 10 itself is used as capsule 43'. In a non-limiting example, exterior element will be a portion 31 or link 3 of a strap or wristband.

The wristband portion is then composed of two bands 310 assembled to each other. The assembly is performed so that the two bands 310 are attached by their periphery, so that the inner space 312 can serve as cavity. This cavity 312 cleverly allows to house a bladder containing a material M2 that expands as a function of a physical magnitude, such as temperature or pressure.

Figure 6:
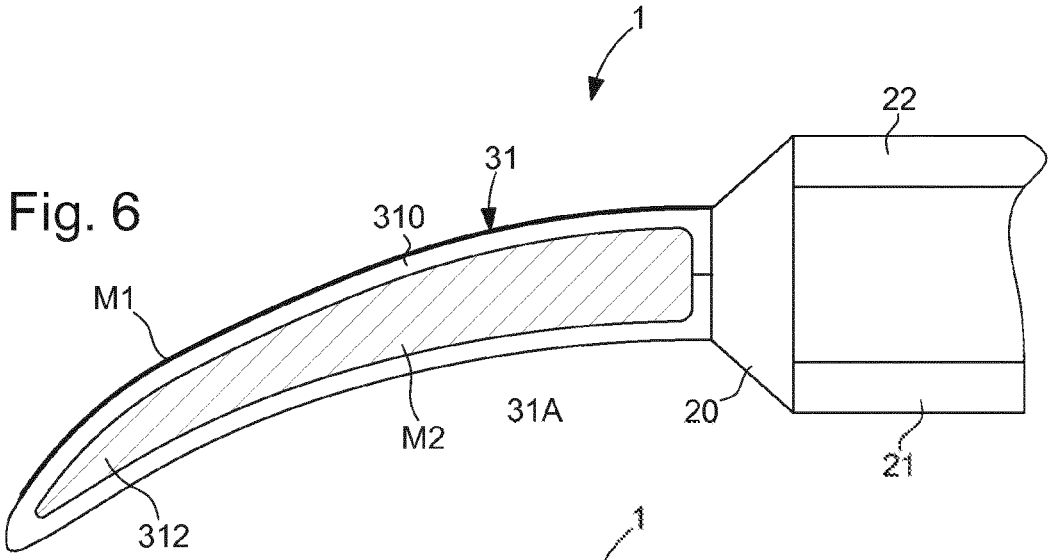

Advantageously according to the invention, one or both of the two bands 310 forming portion 31 of wristband 3 carry material M1, which is capable of reflecting different wavelengths according to the stress applied thereto. This first material M1 is arranged on one and/or the other of these bands in the form of a film or a band, or directly forms part of the material making up said band(s) 310, as seen in FIG. 6.

Figure 7:
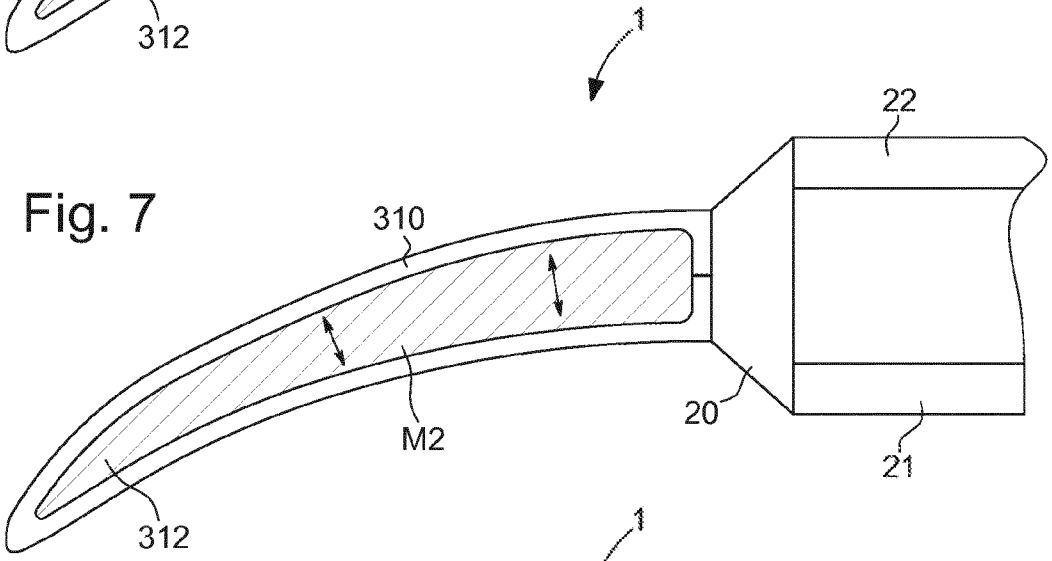

Thus, when, for example, the temperature varies, material M1 reacts and expands or contracts causing deformation of the band or bands forming the wristband portion. This deformation is thus communicated to first material M1 whose structure, under the effect of the applied stress, changes and reflects different wavelengths, as seen in FIG. 7.

Figure 8:
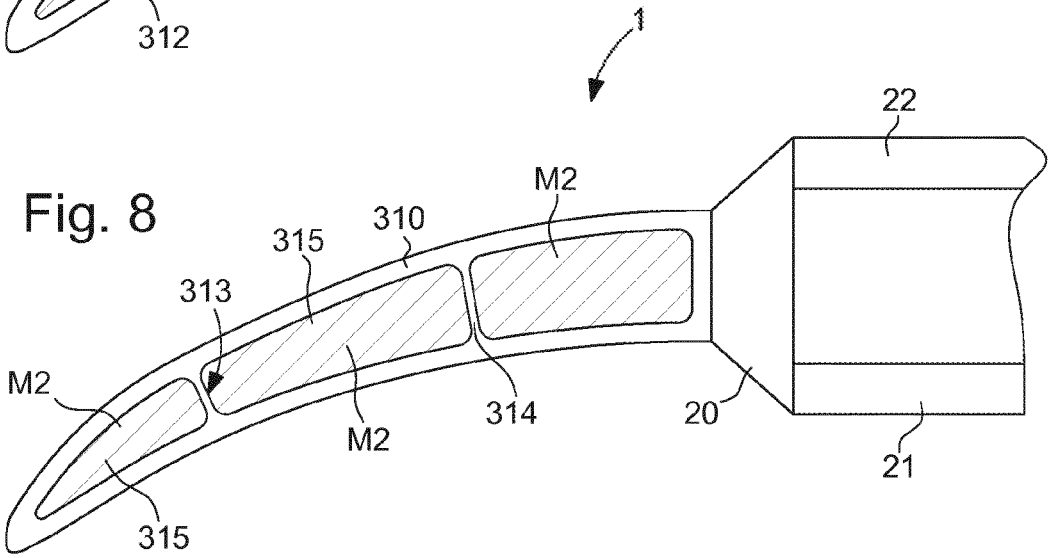

In an advantageous variant, wristband portion 31 includes stiffening structures 313, as seen in FIG. 8. These stiffening structures are arranged between the two bands 310 forming the wristband portion and extend longitudinally or transversely with respect to said portion. These structures allow to increase the torsion resistance of the wristband portion. These structures 313 take the form of at least one wall 314 secured to the two bands. This configuration allows said walls to define various areas 315. For example, having two transverse walls creates three distinct areas in the wristband portion. Cleverly according to this variant, these areas can each be filled with a bladder containing a distinct material M2. This configuration allows to obtain band or bands forming the wristband portion that deform in an irregular manner, since the material M2 of each distinct area reacts differently.

Of course, the bands of the wristband portion could be made of different materials. This advantageously allows to obtain a material having more advantageous deformation characteristics for the band that carries the first material. This means that said band is then more easily deformable, resulting in better reactivity to the expansion of second material M2.

In a third embodiment, application of stress to first material M1 is achieved by means of a mechanical device 14. This mechanical device is arranged to apply stress to the first material, on demand by the user, and thereby change its dimensions and/or its shape.

For this third embodiment, device 14 for applying stress to the first material is a pump device 140. This device is similar to that of U.S. Pat. No. 5,113,599 filed by Reebok®. Such a device broadly consists of a bladder 141 made of plastic material provided with a pumping system 142. Such a pumping system 142 includes a pump 143 and a discharge valve 144 for inflating and deflating plastic bladder 141. The pump 143 used consists of a hollow air chamber 143*a* provided with a hole 143*b* allowing the chamber to be filled with air. The pump may also be provided with a non-return valve 145 using a pair of sheets 145*a* of plastic material which can be welded via a weld spot, to a wall of pump 143. These sheets are bent substantially into a U-shape and allow air to pass only in the direction of the arrow from the pump to the bladder.

To release air from the bladder, an outlet or discharge valve 144 is used. The outlet valve represented in FIG. 9 may include a piston 144*a* comprising a spring 144*b* which urges the piston into the closed position. A flange 144*c* around the periphery of piston stem 144*a* prevents air from escaping between the piston and the outlet connector since the flange is biased in the closed position and in contact with said connector. To release air from bladder 141, the piston is pushed in by the user so that air escapes around the piston stem.

Figure 9:
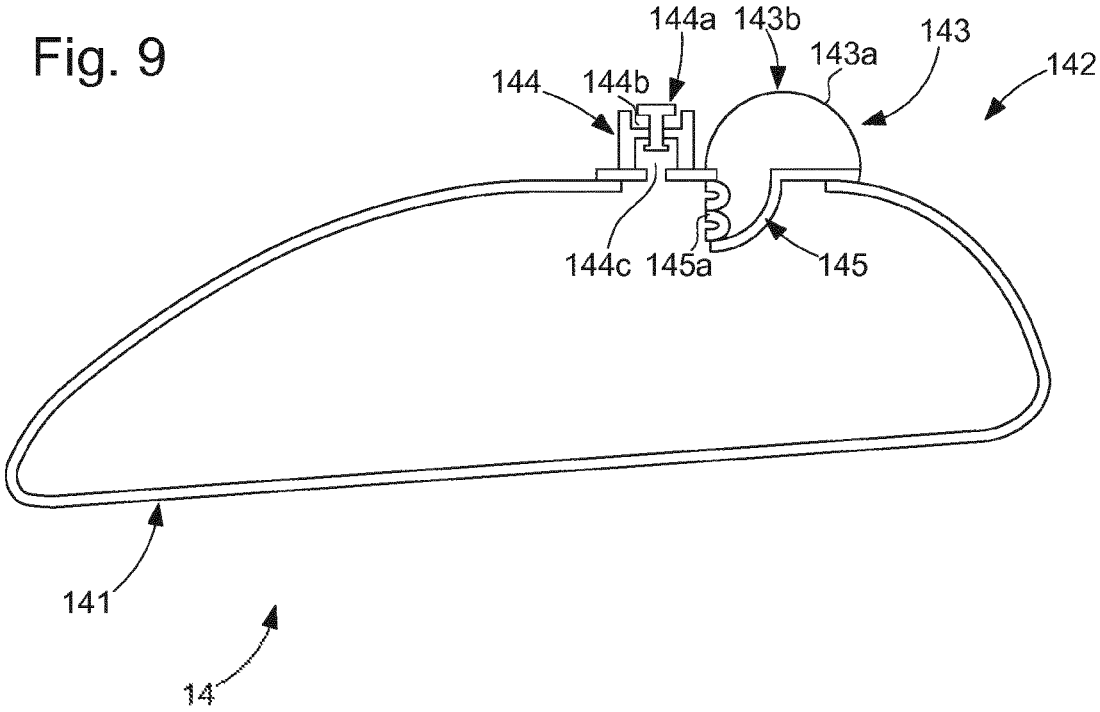
FIGS. 9 to 13 schematically represent a second variant of a second embodiment of the exterior element according to the present invention.

This pump system 142 can then be directly arranged on bladder 141 or be separate therefrom and connected to said bladder via a duct. Arrangement directly on bladder 141 or on the duct can be achieved by making pump system 142 independently on a plastic base. This plastic base will be welded or adhesive bonded onto the bladder or the duct, which are provided with an aperture, as seen in FIG. 9.

Figure 10:
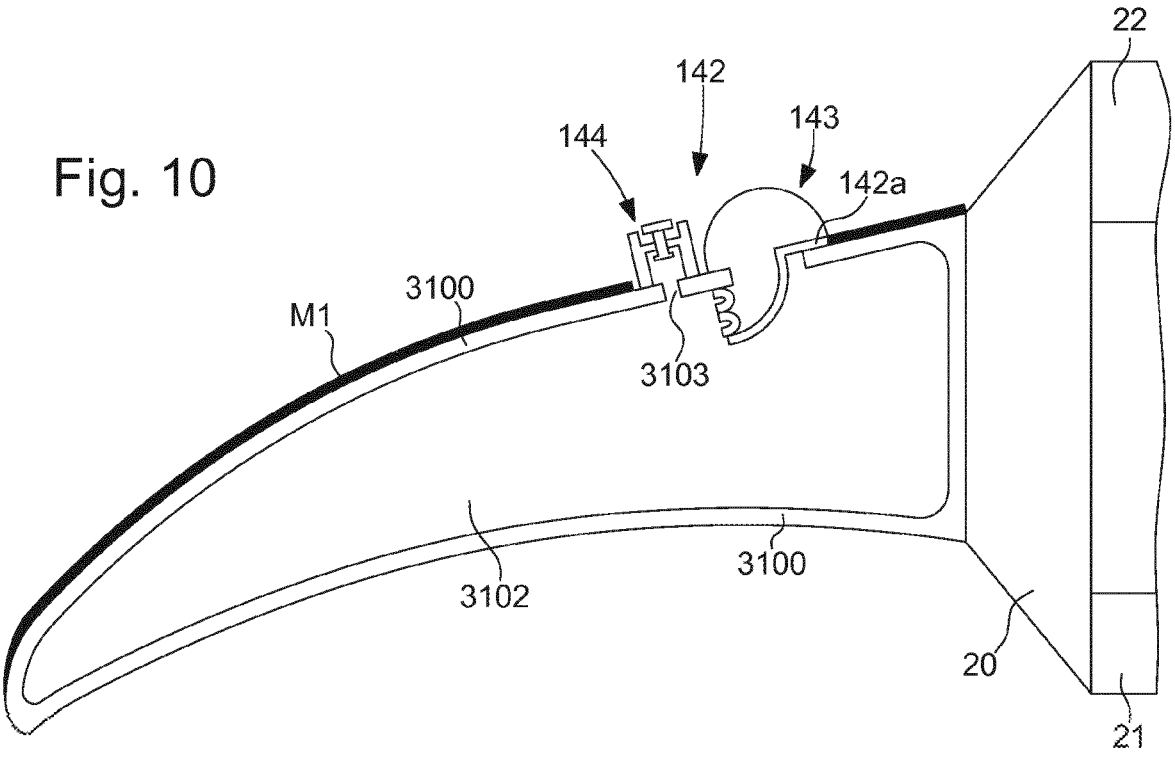

In a first alternative embodiment seen in FIG. 10, exterior element 1 and bladder 141 are in one piece.

In a non-limiting example, exterior element 1 is a portion 31 of a strap or wristband 3. This portion, as described hereinbefore, includes two bands 3100 joined to each other and forming an empty space 3102 between them. This empty space 3102 thus forms an air pocket. One of the two bands 3100, preferably the band that the user will see when wearing the portable object, will be provided with pump system 142 as described.

For this purpose, one of the two bands 3100, preferably the band that will be visible to the user, will be equipped with an aperture 3103. This aperture 3103 is provided for the insertion of pump system 142. The latter is arranged on a base 142*a* which will be welded or adhesive bonded onto band 3100 of wristband portion 31 at aperture 3103. Thus, the user will also be able to act on pump system 142 to inflate or deflate the wristband portion.

The latter is used to carry first material M1, i.e. the material capable of reflecting different wavelengths according to the stress applied thereto. This first material M1 takes the form of a more or less thick film deposited on at least one of the two bands 3100 forming wristband portion 31, but first material M1 could also be arranged to form an integral part of the material from which band(s) 3100 are made.

In a preferred configuration (not represented), for ease of process, said first material M1 includes an opal film encapsulated in two transparent (TPU type) thermoplastic films, and material M1 forms at least one of bands 3100 of the wristband portion. Thus, the manufacture of the bladder and its plastic pump system can be easily achieved by several heat welding operations. Consequently, when the user acts on pump system 142, he can then increase or decrease the air pressure inside wristband portion 31. If the pressure increases, the stress exerted by this pressure increase is transmitted to the bands forming wristband portion 31 until it causes a deformation of one and/or the other of bands 3100. This deformation is transmitted to first material M1 whose structure is then modified, leading to the reflection of a different wavelength. Acting on discharge valve 144 of pump system 142 evacuates air from wristband portion 31, which reduces the pressure inside the latter. This causes a reduction in the stress exerted on bands 3100, which then revert to their initial shape. First material M1 then reverts to its initial structure and therefore reflects its original wavelength.

Of course, bands 3100 forming wristband portion 31 could be made of different materials. This advantageously allows to obtain a material having more advantageous deformation characteristics for the band that carries first material M1. This means that said band 3100 is then more easily deformable, resulting in better reactivity to pumping.

In a second alternative embodiment shown, exterior element 10 and bladder 141 are separate. In a non-limiting example, exterior element 10 is a wristband portion 31. This portion, as described hereinbefore, includes two bands 3100 joined to each other and forming an empty space 3102 between them.

Advantageously according to this alternative, empty space 3102 between the two bands 3100 is used as a housing. This housing is used for housing a bladder 141 that can be inflated and deflated and is provided with an aperture 3103 for receiving pump system 142, as described hereinbefore. The principle is thus that activation of pump 145 allows bladder 141 to be inflated or deflated causing its deformation and the deformation of bands 3100 forming the wristband portion.

Figure 11:
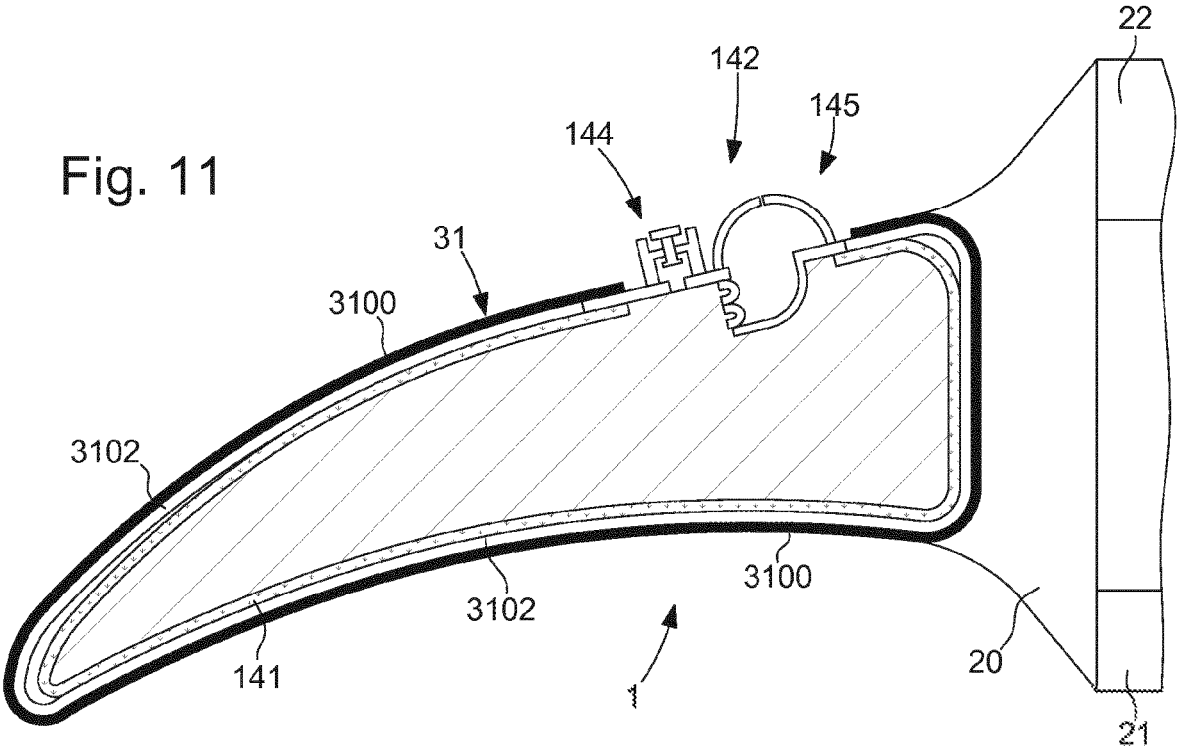

According to a first solution shown in FIG. 11, one and/or the other band 3100 forming the wristband portion carries first material M1, as described for the first alternative embodiment. Thus, inflating or deflating bladder 141 causes stress to be applied/not applied to the wristband portion which deforms/does not deform.

Figure 12:
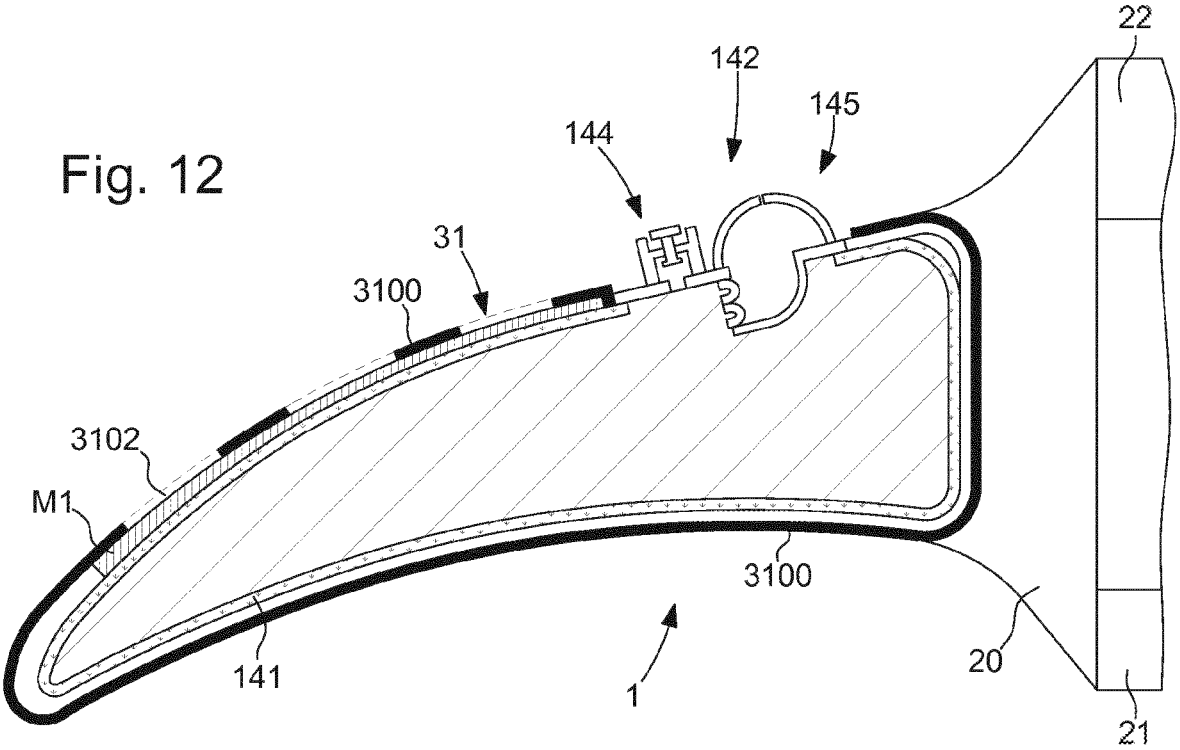

According to a second solution seen in FIG. 12, bladder 141 is arranged to be the element that carries first material M1. This first material M1 takes the form of a film deposited on the bladder, but first material M1 could also be arranged to form an integral part of the material from which bladder 141 is made. Cleverly, at least one of bands 3100 of wristband portion 31 contains apertures 3103. These apertures 3103 allow the user to see bladder 141 reflecting a particular wavelength through band(s) 3100 forming wristband portion 31. Further, when bladder 141 is inflated under the action of pump 145, bladder 141 can be partially inserted into apertures 3103 and thus deform locally. This local deformation thus produces local stress on first material M1, and therefore a change in the wavelength that it can reflect.

Figure 13:
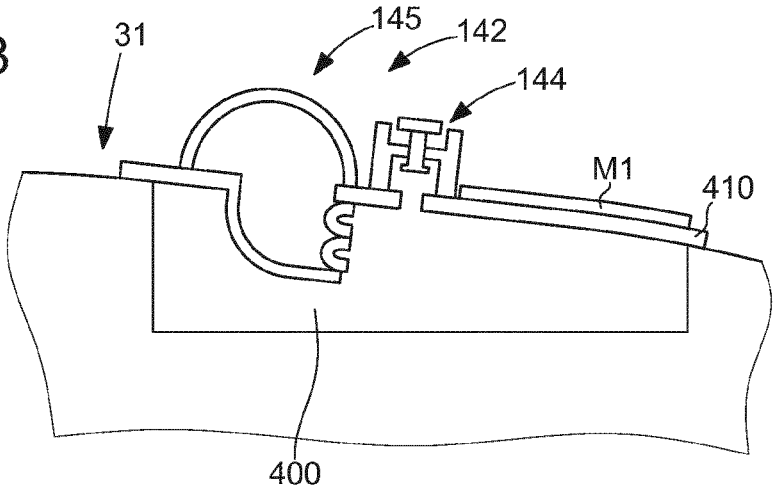

In a third alternative, seen in FIG. 13, exterior element 1, which is a wristband portion 31 here, is formed of a recess 400 and a flexible film 410 formed of material M1 or carrying material M1. The recess/film assembly forms bladder 141. Similarly to the first alternative embodiment, a pump system 142 can thus be arranged on bladder 141 to inflate or deflate bladder 141 and thereby apply a geometric stress to material M1 and thus change its colour.

In a preferred version of this alternative, for ease of process, recess 400, pump system 142 and flexible film 410 which seals the bladder are made of thermoplastic. More preferably, recess 410 is incorporated in a wristband portion 31 obtained by injection moulding. Material M1 is formed of an opal polymer film encapsulated between two thermoplastic sheets. In this manner, exterior element 1 can be obtained by simple assembly operations (ultrasonic, heat welding or other).

Figure 14:
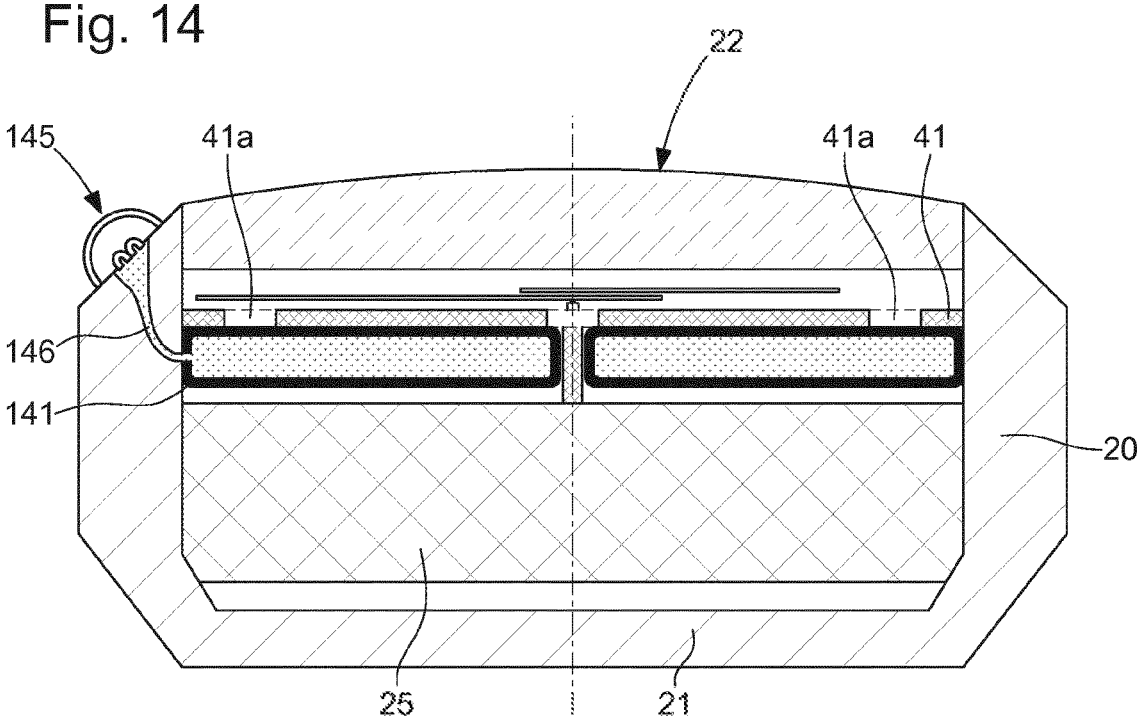
FIGS. 14 and 15 schematically represent a version of the exterior element according to the present invention wherein said exterior element is a dial.
Figure 15:
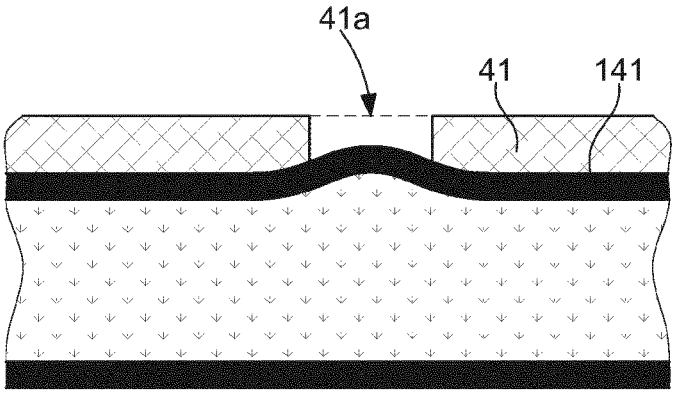

In an example embodiment seen in FIGS. 14 and 15, exterior element 1 is a watch dial 41, and the portable object is a watch including a timepiece movement 25. In such case, there is arranged a bladder 141 located underneath dial 41; this bladder 141 may be made from two heat welded half-bladders. The possibility of using two half-bladders makes it possible to obtain a bladder 141 made of different materials and to obtain half-bladders of different stiffness, so as to have one half-bladder serving as support and one 'active' half-bladder that will deform easily. This bladder 141 can then be disposed inside the housing formed by dial 41, case middle 20 and the plate of the timepiece movement.

Bladder 141 is then fed air via a pumping system 142 placed outside, on watch case 2, so that it can be operated by the wearer of the watch. An ultrasonic bond or seal allows the pumping system to be assembled to the watch case in a sealed manner. The pumping system is connected to the bladder via a duct 146. Duct 146 forms an integral part of bladder 141 and is created by adding circular welds to reduce the thickness of the inflated area.

Dial 41 has apertures 41*a* so that bladder 141 is visible to the wearer of the portable object. The part of the bladder visible to the wearer is the part that carries first material M1. Thus, when the wearer acts on the pumping system, the bladder is inflated or deflated and material M1 is subjected to stress which causes it to change the wavelength of light that it reflects.

In a preferred version of the invention, the bladder carrying material M1 is inside an aperture or a perforated dial so that the bladder is visible. When the pump is activated, the bladder carrying material M1 is inflated, the opal design changes colour and appears in relief with respect to the rest of the dial.

For all the embodiments of the invention, it is possible to change the basic colour and the colour variation, by acting on the actual structure of the opal material forming M1 during manufacture. Indeed, as described in the literature, the refractive indices, size and spacing of the components made of opal material allow control over its original colour and its colours after being subjected to mechanical stress.

It will be understood that the embodiments explained above are not limited to a wristband or dial but can also be applied to a watch case, a case middle, a bezel, a crown, a push button, a clasp or buckle, or a crystal.

It will be clear that various alterations and/or improvements and/or combinations evident to those skilled in the art may be made to the various embodiments of the invention set out above without departing from the scope of the invention defined by the annexed claims.

In the first embodiment, it would be possible to envisage the exterior element being made of a material that absorbs water. Such a configuration allows the exterior element to inflate with moisture and thereby cause stress to appear on the first material.

The invention claimed is:

1. An exterior element for portable objects comprising:

a support on which is arranged a first material, the first material capable of reflecting different visible wavelengths as a function of mechanical stress applied to the first material;

a device that allows to modify the stress applied to the material, wherein the device which allows to modify the stress applied to the first material uses a second material whose volume is capable of varying as a function of a physical magnitude, the second material being associated with a flexible element carrying the first material.

2. An exterior element according to claim 1, wherein the support includes at least one recess closed by a film provided with the first material and forming a housing, the housing accommodating a capsule including two joined half-shells filled with the second material.

3. An exterior element according to claim 2, wherein each capsule is filled with the second material, which second material may be different from one capsule to another.

4. An exterior element according to claim 1, wherein the support includes at least one recess closed by a film including the first material and forming a housing, inside which a capsule/piston system and the material are placed, the capsule/piston system is formed of a half-shell and a piston, such that variation in volume of the second material causes movement of the piston.

5. An exterior element according to claim 3, wherein each recess is filled with the second material, which second material may be different from one housing to another.

6. An exterior element according to claim 1, wherein the support is formed by at least two joined parts, secured to each other by their periphery, to leave an empty space between the two parts, at least one of the two parts being flexible and carrying the first material, the space forming the recess containing the second material.

7. An exterior element according to claim 6, wherein the support formed by the at least two parts further includes at least one structure extending between the two parts to delimit at least two areas, each area configured to contain a bladder.

8. An exterior element according to claim 7, wherein each area contains a second specific material.

9. An exterior element according to claim 1, wherein the device which allows to modify the stress applied to the first material includes a bladder made of plastic materials connected to a pump system allowing the bladder to be inflated/deflated, the pump system including a hollow air cavity including a hole allowing the air cavity to be filled with air and a non-return valve including a pair of sheets of plastic material both welded to a wall of the pump, the sheets being bent substantially in a U-shape and arranged with respect to each other to allow air to pass only in the direction of the bladder, the device being associated with a flexible element carrying the first material.

10. An exterior element according to claim 9, wherein the support is formed by at least two parts attached to each other by their periphery to leave an empty space therebetween, the space allowing the bladder to be housed therein, one of the parts forming the portion including an aperture so that the pump system can be inserted therein and remain accessible.

11. An exterior element according to claim 10, wherein at least one of the two parts is flexible and carries the first material.

12. An exterior element according to claim 11, wherein the flexible element is at least partly formed by the first material.

13. An exterior element according to claim 10, wherein the at least one of the two parts is perforated, the first material being held by the bladder acting as the flexible element, and visible through the perforations.

14. An exterior element according to claim 9, wherein the support is formed by at least two joined parts, secured to each other by their periphery, to leave an empty space between the two parts, at least one of the two parts being flexible and carrying the first material, the space forming the bladder of the pump system, one of the parts forming the portion being provided with an aperture for arranging the pump system therein.

15. An exterior element according to claim 1, wherein the first material takes a form of a film deposited on the support.

16. An exterior element according to claim 1, wherein the flexible element is at least partly formed by the first material.

17. A portable object including a case closed by a case back and a cover, wherein the portable object includes at least one exterior element according to claim 1.

18. A portable object according to claim 17, wherein the portable object is a timepiece comprising a case formed by a case middle closed by a case back and a crystal, and a wristband attached to the case middle by two pairs of horns, the wristband including at least one wristband portion, and wherein the exterior element is included in one of the case middle, the case back, or the wristband.

19. A portable object according to claim 18, wherein the timepiece further comprises a timepiece movement providing time information to a display including a dial, the dial forming part of the case middle, the case back, or the wristband, from which the exterior element is chosen.

20. An exterior element according to claim 1, wherein the first material is a photonic crystal or an opal material.

21. An exterior element for portable objects comprising:

a bistable metal band coated with a first material, the first material capable of reflecting different visible wavelengths as a function of applied mechanical stress, the metal band being bistable such that the metal band modifies the stress applied to the material;

wherein the metal band is made of a second material whose volume is capable of varying as a function of a physical magnitude, the second material being associated with a flexible element carrying the first material.

* * * * *